US012290213B2

(12) United States Patent
Raddatz

(10) Patent No.: US 12,290,213 B2
(45) Date of Patent: May 6, 2025

(54) TOWEL DISPENSER

(71) Applicant: Elizabeth Raddatz, Orland Park, IL (US)

(72) Inventor: Elizabeth Raddatz, Orland Park, IL (US)

( * ) Notice: Subject to any disclaimer, the term of this patent is extended or adjusted under 35 U.S.C. 154(b) by 367 days.

(21) Appl. No.: 17/810,679

(22) Filed: Jul. 5, 2022

(65) Prior Publication Data

US 2023/0000293 A1 Jan. 5, 2023

Related U.S. Application Data

(60) Provisional application No. 63/218,315, filed on Jul. 3, 2021.

(51) Int. Cl.
*A47K 10/26* (2006.01)

(52) U.S. Cl.
CPC ..... *A47K 10/26* (2013.01)

(58) Field of Classification Search
CPC ..... A47K 10/26
USPC ..... 221/33–63
See application file for complete search history.

(56) References Cited

U.S. PATENT DOCUMENTS 5,975,349 A * 11/1999 Menes ..... B65H 3/24 221/268
6,769,566 B1 * 8/2004 Rubin ..... A47F 1/06 221/56
2008/0128451 A1 * 6/2008 Krauth ..... B65D 43/169 221/63
2009/0120950 A1 * 5/2009 Titas ..... A47K 10/3818 221/45
2012/0318818 A1 * 12/2012 Kobayashi ..... A47K 10/422 221/52
2013/0221019 A1 * 8/2013 Rozek ..... A47K 10/427 221/36
2014/0217112 A1 * 8/2014 Young ..... A47K 10/425 221/45
2014/0319164 A1 * 10/2014 Wilson ..... A47K 10/422 221/45

* cited by examiner

*Primary Examiner* — Gene O Crawford
*Assistant Examiner* — Ayodeji T Ojofeitimi
(74) *Attorney, Agent, or Firm* — Incubate IP; Randy R. Micheletti

(57) ABSTRACT

The present disclosure provides towel dispenser apparatus and methods of making and using same.

15 Claims, 15 Drawing Sheets

TOWEL DISPENSER

PRIORITY CLAIM

This application claims priority to U.S. Provisional Patent Application Ser. No. 63/218,315, filed on Jul. 3, 2021, the entire contents of which are incorporated herein by reference and relied upon.

FIELD OF DISCLOSURE

The present disclosure relates to the field of towel dispensers, and more specifically to a top-pull dispenser for dispensing towels.

BACKGROUND

Currently available towel dispensers generally result in a transfer of germs from users to subsequent users. When taking a towel, currently available dispensers enable unused towels in the dispenser to get wet and thus more likely to transfer germs from one user to the next.

There remains a need for a towel dispenser that does reduces or eliminates the transfer of germs, keeps unused towels dry, and conveniently dispenses towels for all users. The present disclosure describes products and methods of using such products that meet that need.

SUMMARY

The present disclosure relates to the field of towel dispensers, and more specifically to a top-pull dispenser for dispensing towels.

In some embodiments, the present disclosure provides a top-pull dispenser for towels comprising a housing having a housing back, housing sides, a housing bottom, and a detachable top cover connected thereto; the detachable top cover and the housing being disposed offset from vertical by a predetermined offset angle; an opening in the top periphery of said top cover configured to dispense individual towels therethrough; an elevator system configured to elevate a support tray along the offset angle; a spring-loaded mechanism to propel the support tray along the elevator system, wherein the support tray includes a generally planar top surface and is slidably associated with the elevator system along the offset angle; and a locking member for fastening said top cover to the housing back and housing sides.

In some embodiments, the present disclosure provides a locking member for releasably locking the top cover to the housing back and housing sides, wherein the locking member comprises a latch mechanism, and is unlockable by depressing the latch mechanism to release the top cover from the housing back and housing sides, and wherein the top cover cannot be removed from the housing without first unlocking the locking member.

In other embodiments, the locking member comprises a mechanical fastener and the locking member comprises a spring-loaded button configured to enable one-touch activation and disengagement of the top cover.

These and other embodiments are described in greater detail herein.

BRIEF DESCRIPTION OF THE DRAWINGS

The detailed description of some embodiments of the present disclosure is made below with reference to the accompanying figures, wherein like numerals represent corresponding parts of the figures.

DETAILED DESCRIPTION

Figure 1A:
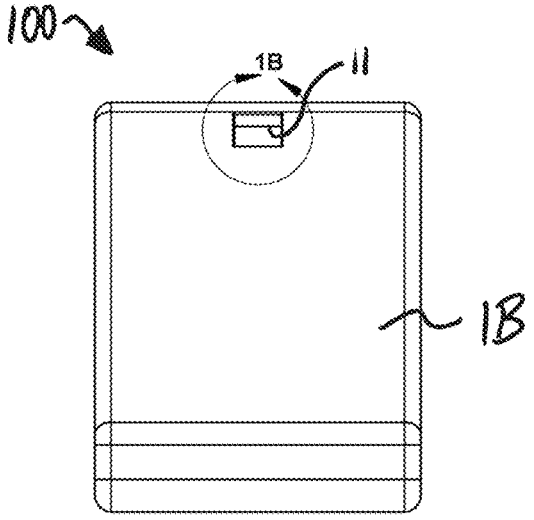
FIG. 1A shows a plan front view of a towel dispenser apparatus consistent with the embodiments of the present disclosure.

Referring generally to FIGS. 1A-11, the present disclosure provides towel dispensers 100. The materials, methods, and examples described are illustrative in nature and not intended to be limiting. Accordingly, this disclosure should not be construed as limited to the illustrated embodiments. Other features and advantages of the disclosure will be apparent from the following detailed description and claims.

Generally, towel dispensers 100 consistent with the present disclosure include a housing 1A having a housing back 1B; housing sides 2, 3; a housing bottom 4, and a detachable top cover 5 including an opening 6. The housing 1A generally defines a chamber in which towels (not shown) are stored for use. In some embodiments, the housing 1A is formed of plastic. For example and without limitation, the plastic for the housing 1A can be injection molded, blow molded, extruded, casted, vacuum formed, machined, and 3D printed. In some embodiments, the housing 1A is formed of metal.

The detachable top cover 5 and housing 1A are disposed offset from vertical by a predetermined offset angle 14. The offset angle 14 reduces contamination and spread of bacteria and viruses by orienting the detachable top cover 5 in a way that reduces the risk that a user drips or spreads contaminants to unused towels still inside the towel dispenser. The angled orientation causes any water or contamination that would have dripped onto the unused towels to instead drip onto the surrounding surfaces (e.g., onto the housing back 1B) because the offset angle 14 causes the user's wet or dirty hands to be oriented out of alignment with the opening top periphery 6, preventing the unused towels from being wet or dirtied. Water or contaminants that may drip onto the detachable top cover 5 will drip down away from the unused towels because of the top cover 5 being oriented at a predetermined offset angle 14. For example and without limitation, the housing top cover 5 is may in some embodiments be offset from vertical by an offset angle 14 of about 30 to about 60 degrees relative to vertical, such as about 30 degrees to about 35 degrees, about 35 degrees to about 40 degrees, about 40 degrees to about 45 degrees, about 45 degrees to about 50 degrees, about 50 degrees to about 55 degrees, or about 55 degrees to about 60 degrees. In other embodiments the housing top cover 5 is offset from vertical by a predetermined offset angle 14 of about 30 to about 60 degrees relative to vertical, such as about 30 degrees, about 31 degrees, about 32 degrees, about 33 degrees, about 34 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, about 46 degrees, about 47 degrees, about 48 degrees, about 49 degrees, about 50 degrees, about 51 degrees, about 52 degrees, about 53 degrees, about 54 degrees, about 55 degrees, about 56 degrees, about 57 degrees, about 58 degrees, about 59 degrees, or about 60 degrees. For example and without limitation, the housing back 1B may in some embodiments be offset from vertical by a predetermined offset angle 14 of about 30 to about 60 degrees relative to vertical, such as about 30 degrees to about 35 degrees, about 35 degrees to about 40 degrees, about 40 degrees to about 45 degrees, about 45 degrees to about 50 degrees, about 50 degrees to about 55 degrees, or about 55 degrees to about 60 degrees. In other embodiments the housing back 1B is offset from vertical by a predetermined offset angle 14 of about 30 to about 60 degrees relative to vertical, such as about 30 degrees, about 31 degrees, about 32 degrees, about 33 degrees, about 34 degrees, about 35 degrees, about 36 degrees, about 37 degrees, about 38 degrees, about 39 degrees, about 40 degrees, about 41 degrees, about 42 degrees, about 43 degrees, about 44 degrees, about 45 degrees, about 46 degrees, about 47 degrees, about 48 degrees, about 49 degrees, about 50 degrees, about 51 degrees, about 52 degrees, about 53 degrees, about 54 degrees, about 55 degrees, about 56 degrees, about 57 degrees, about 58 degrees, about 59 degrees, or about 60 degrees. In some embodiments, such as shown in FIGS. 3A-3G, the housing back 1B is vertical. In some embodiments, such as shown in FIGS. 2A-2G, the housing top cover 5 is offset from vertical by an angle of about 30 degrees to about 60 degrees relative to vertical and the height of the housing back 1B is about equal to the height of the housing sides 2 and 3.

For example and without limitation, in some embodiments the height of the housing apparatus is about 13 inches and the width of the apparatus is about 13 inches. In other embodiments, the height of the apparatus is about 13 inches and the width of the apparatus is about 4 inches. In other embodiments, for example and without limitation, the height of the apparatus is about 6 inches and the width of the apparatus is about 6 inches.

The housing back 1B and housing sides 2 and 3 may in some embodiments comprise holes (not shown) in the periphery configured to enable attachment by removable mechanical fasteners. For example and without limitation, the mechanical fasteners can be screws, rivets, or locking tabs. The housing back 1B and housing sides 2 and 3 may be secured to the housing bottom 4 by removable mechanical fasteners. For example and without limitation, the mechanical fasteners can be screws, rivets, or locking tabs.

Figure 4A:
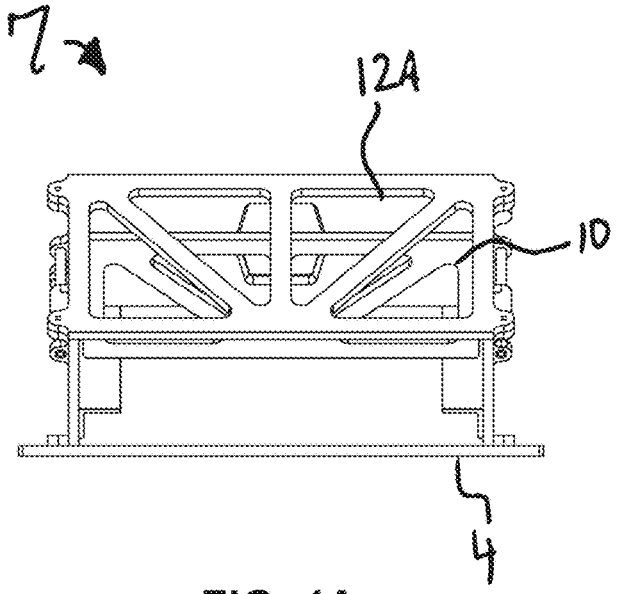
FIG. 4A shows a rear plan view of a portion of a towel dispenser apparatus consistent with another embodiments of the present disclosure.
Figure 4B:
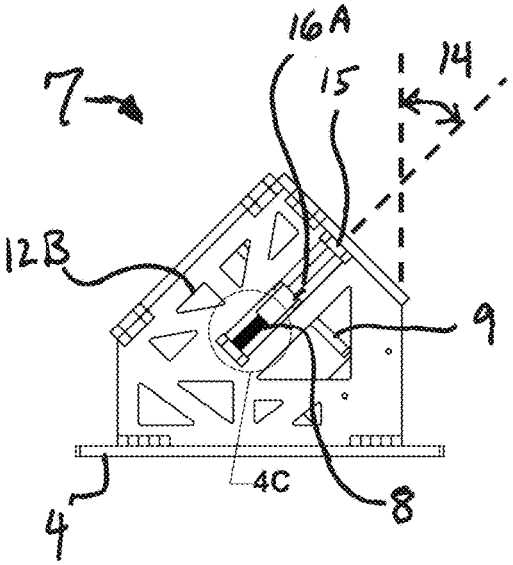
FIG. 4B shows a left side plan view of the portion of the towel dispenser apparatus of FIG. 4A.
Figure 4C:
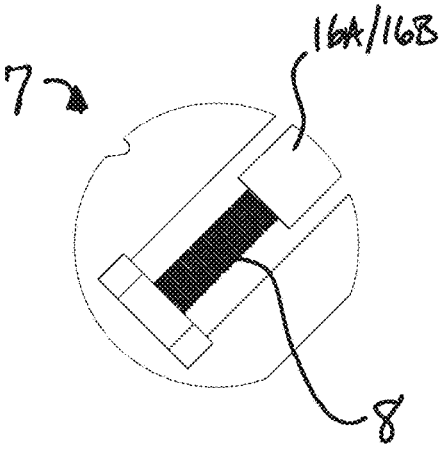
FIG. 4C shows an enlarged plan view of a portion of the view of FIG. 4B.
Figure 4D:
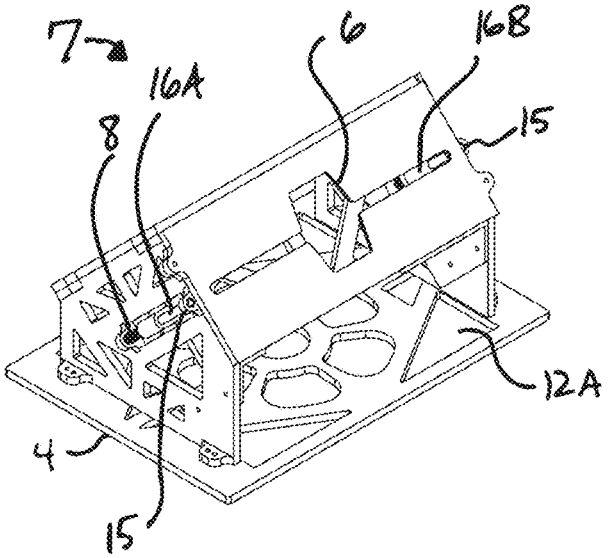
FIG. 4D shows a perspective view of the portion of the towel dispenser of FIG. 4A.
Figure 4E:
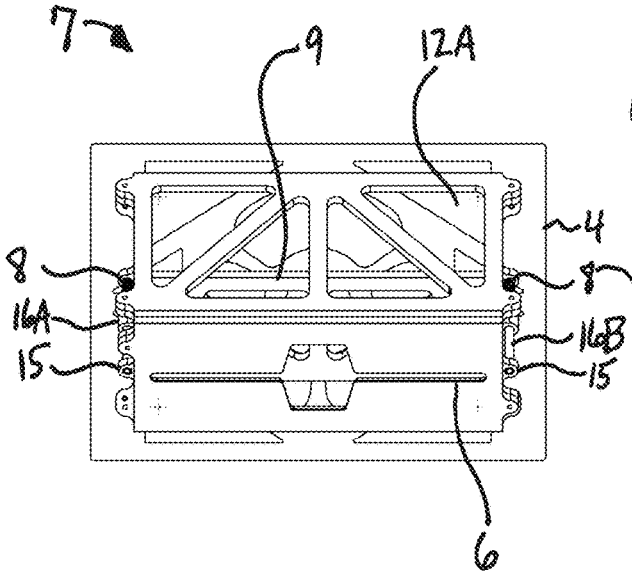
FIG. 4E shows a top plan view of the portion of the towel dispenser of FIG. 4A.
Figure 4F:
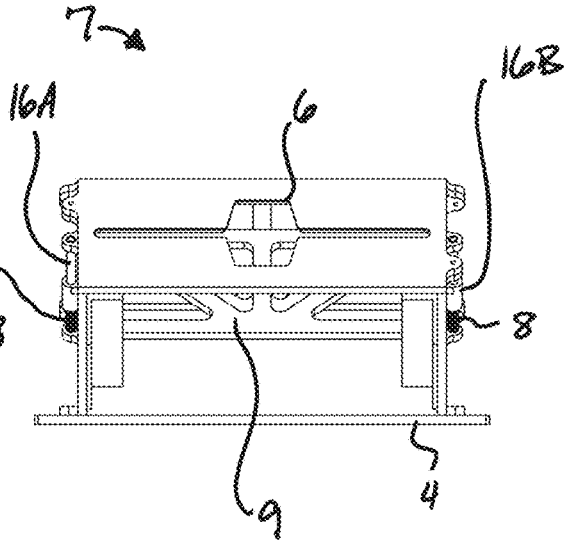
FIG. 4F shows a front plan view of the portion of the towel dispenser of FIG. 4A.
Figure 4G:
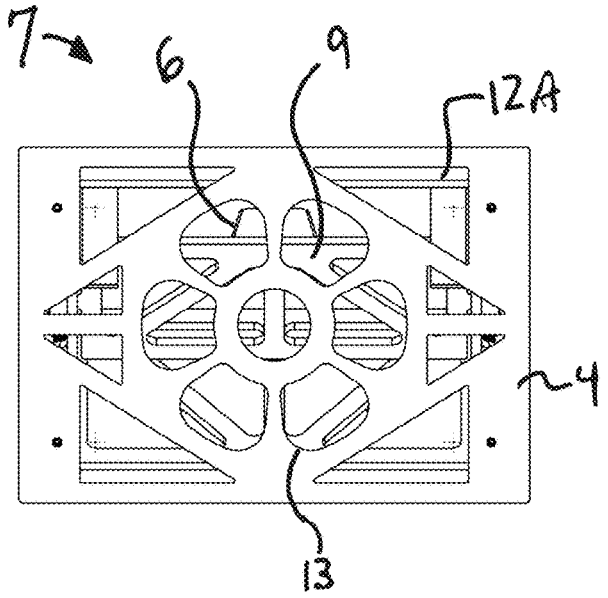
FIG. 4G shows a bottom plan view of the portion of the towel dispenser of FIG. 4A.
Figure 4H:
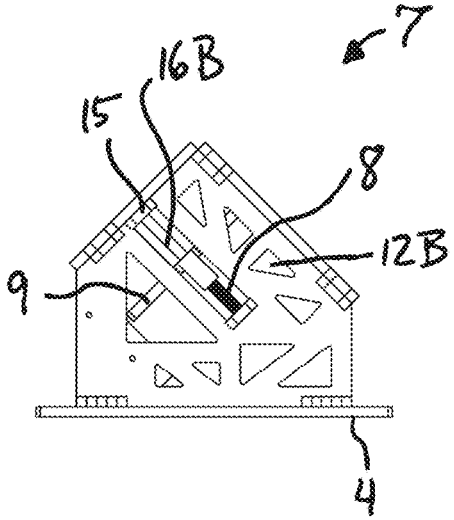
FIG. 4H shows a right side plan view of the portion of the towel dispenser of FIG. 4A.
Figure 5A:
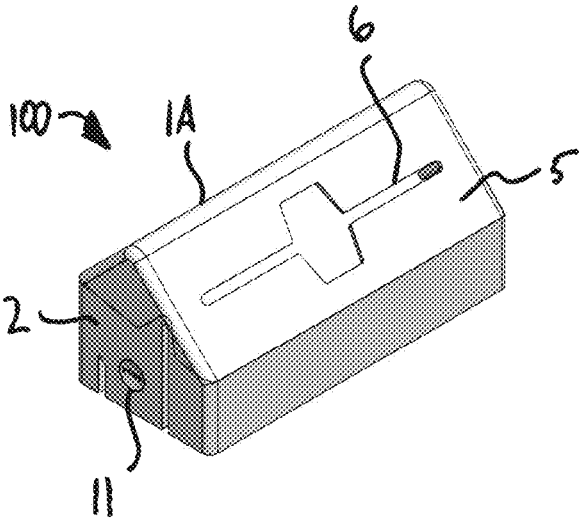
FIGS. 5A-5B show front and rear perspective views, respectively, of a towel dispenser apparatus consistent with another embodiment of the present disclosure.
Figure 5B:
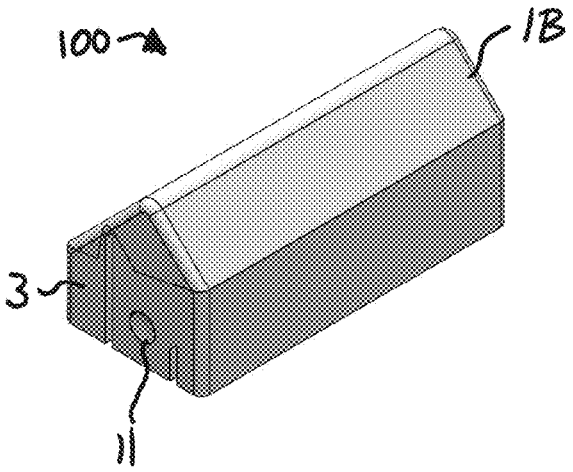
Figure 5C:
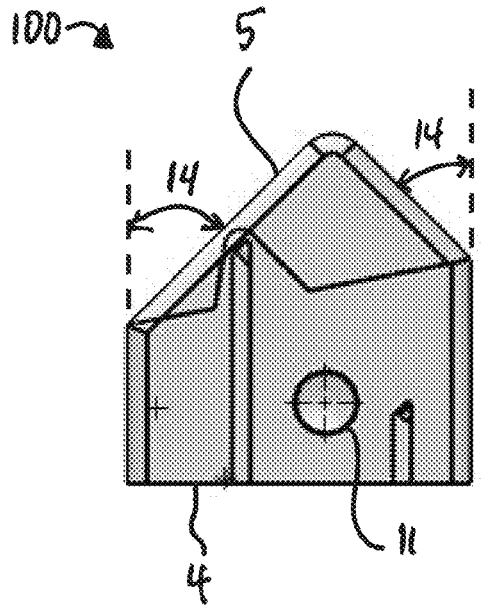
FIG. 5C shows a right side plan view of the towel dispenser apparatus of FIG. 5A.
Figure 5D:
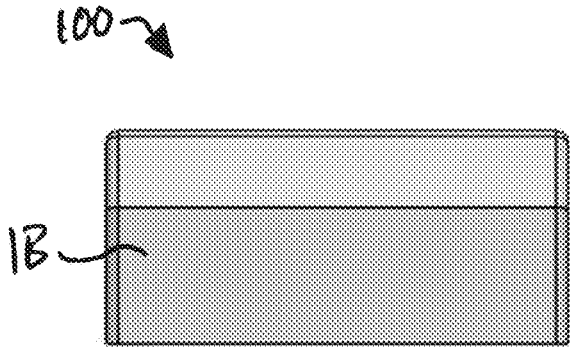
FIG. 5D shows rear plan view of the towel dispenser apparatus of FIG. 5A.
Figure 5E:
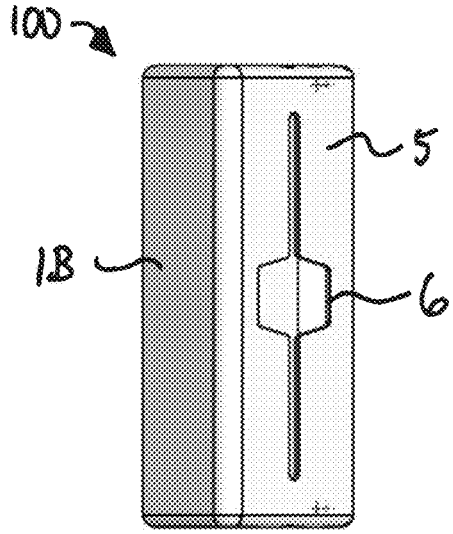
FIG. 5E shows a top plan view of the towel dispenser apparatus of FIG. 5A.
Figure 5F:
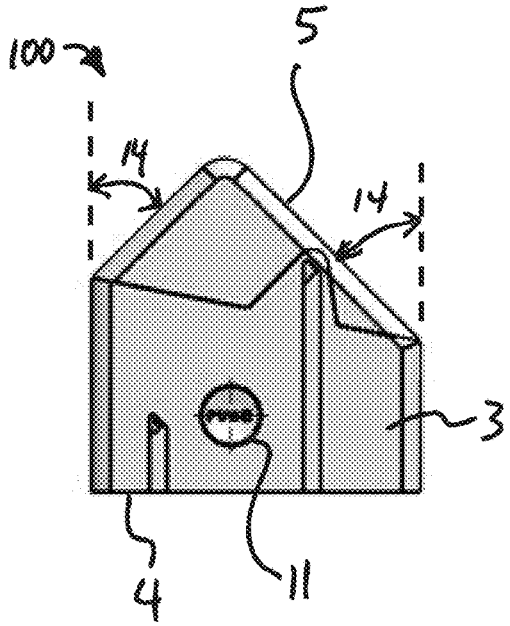
FIG. 5F shows a left side plan view of the towel dispenser apparatus of FIG. 5A.
Figure 5G:
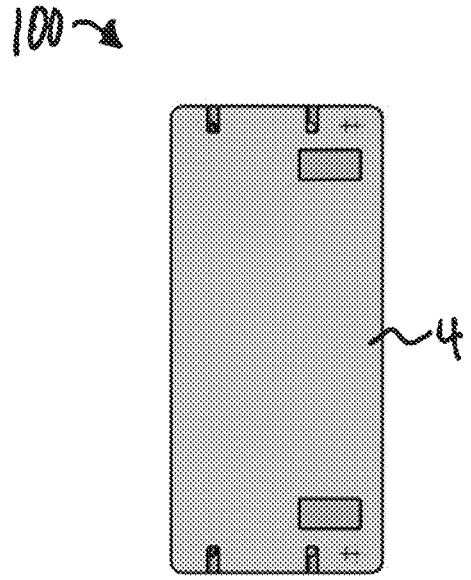
FIG. 5G shows a bottom plan view of the towel dispenser apparatus of FIG. 5A.
Figure 5H:
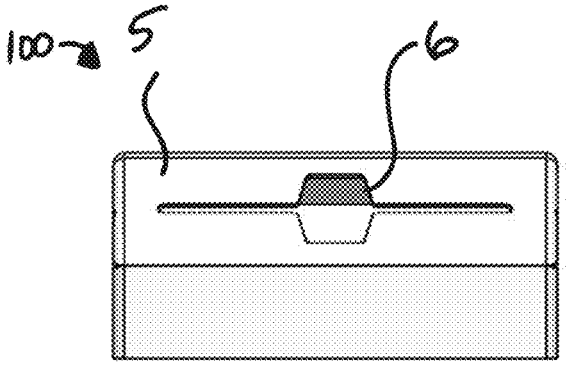
FIG. 5H shows a front plan view of the towel dispenser apparatus of FIG. 5A.
Figure 6:
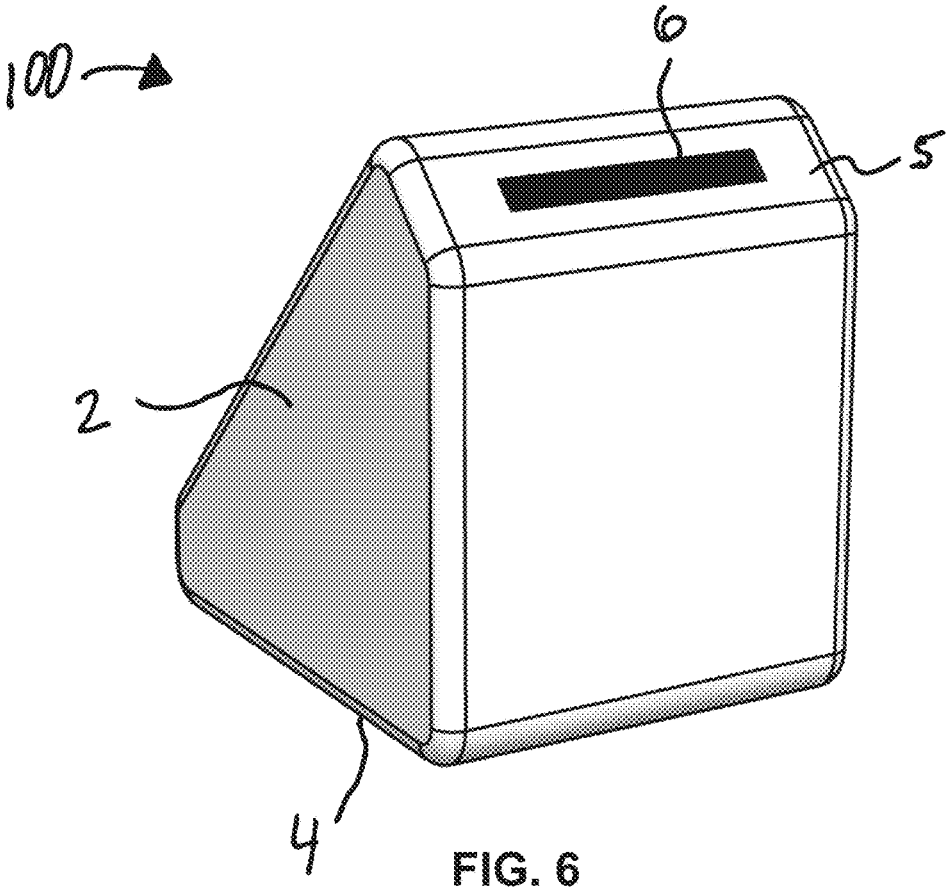
FIG. 6 shows a perspective view of a towel dispenser apparatus consistent with one embodiment of the present disclosure.
Figure 7:
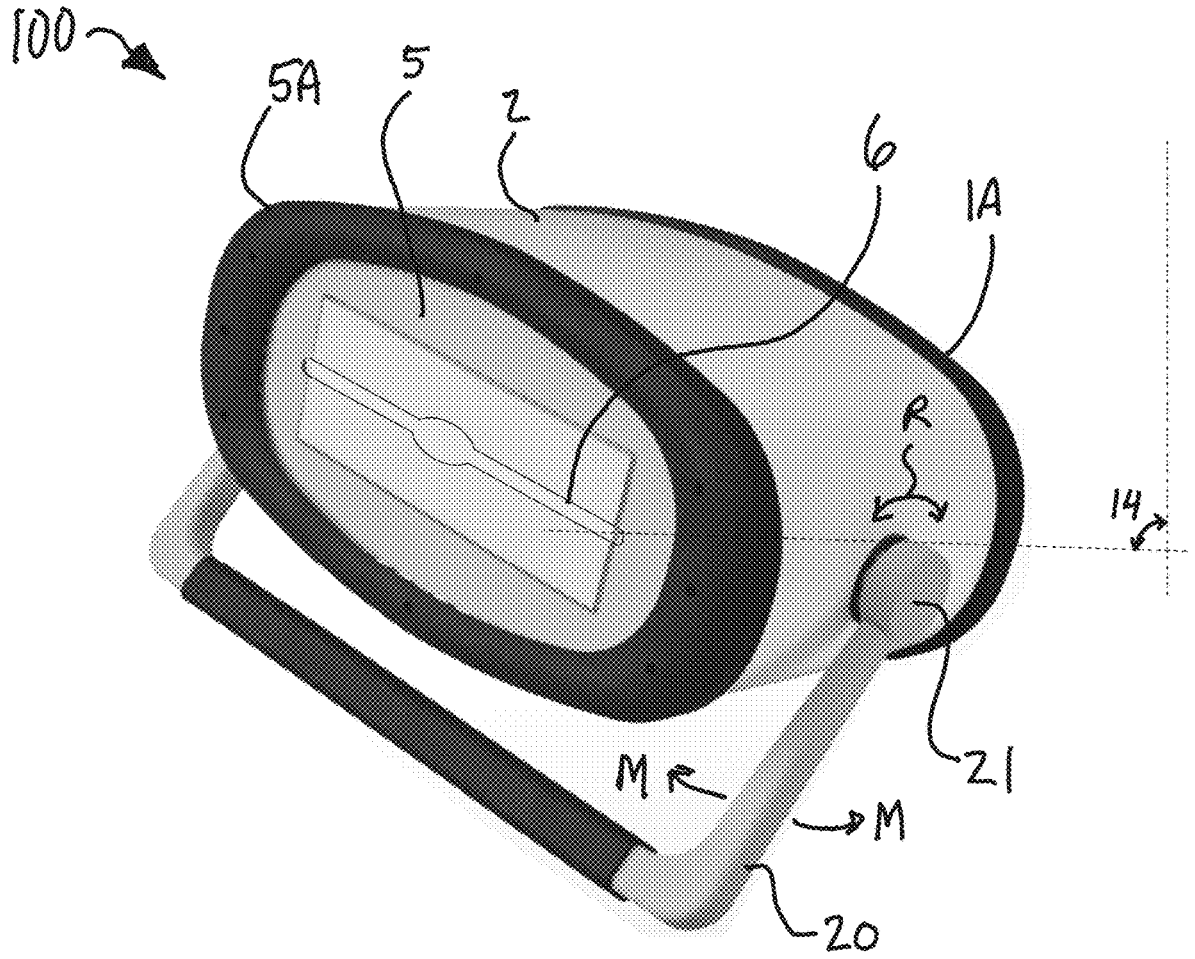
FIG. 7 shows a perspective view of a towel dispenser apparatus consistent with another embodiment of the present disclosure.
Figure 8:
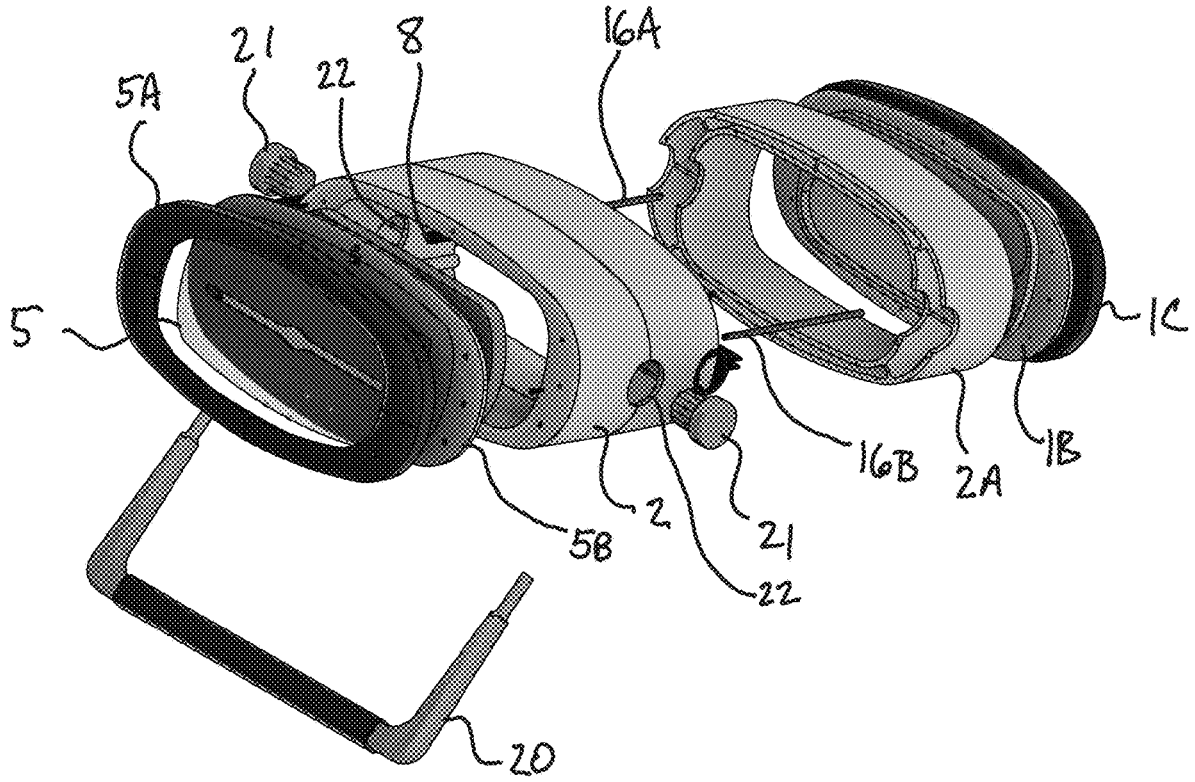
FIG. 8 shows an exploded perspective view of the towel dispenser apparatus of FIG. 7.
Figure 9:
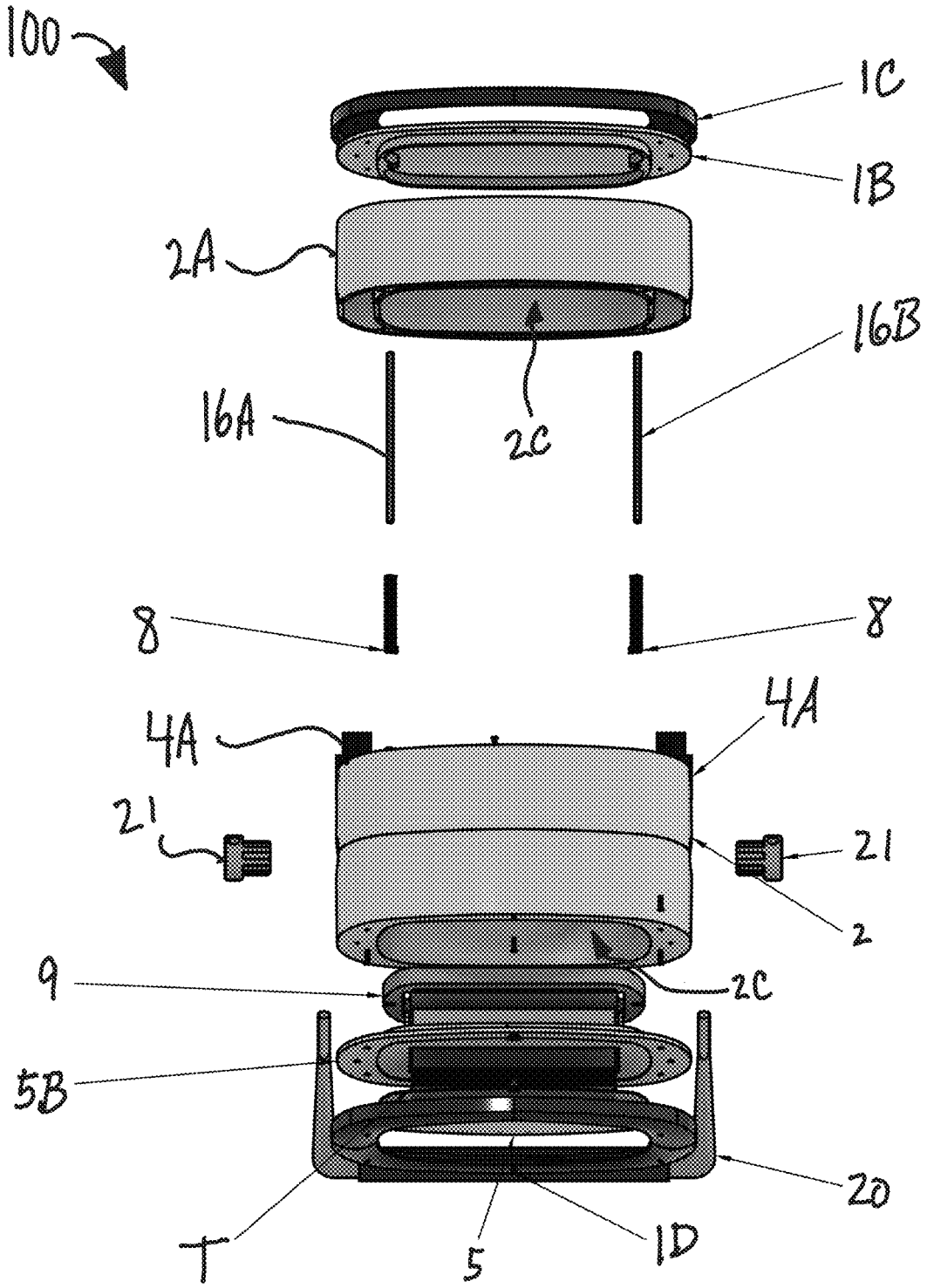
FIG. 9 shows an exploded top view of the towel dispenser apparatus of FIG. 7.
Figure 10A:
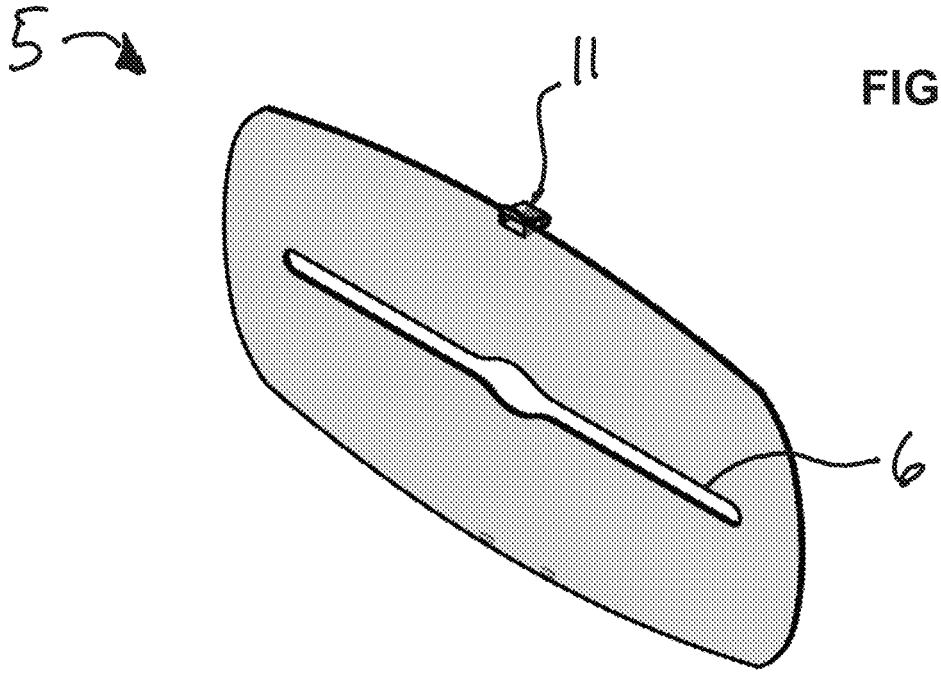
FIG. 10A shows a perspective view of a faceplate component of a towel dispenser apparatus consistent with one embodiment of the present disclosure.
Figure 10B:
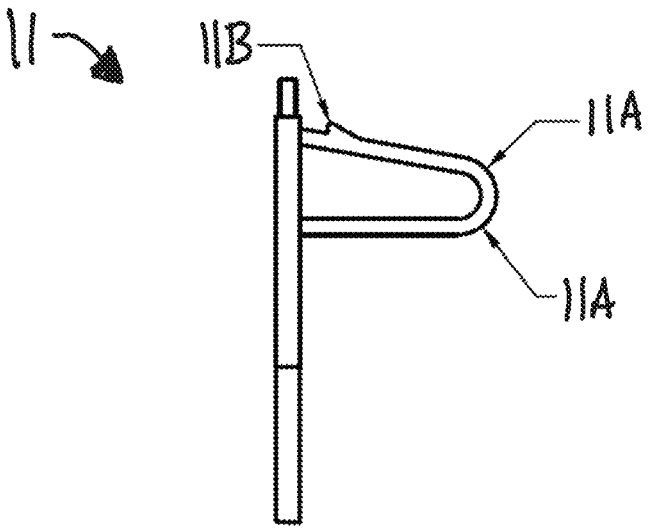
FIG. 10B shows a side view of the locking tab of the faceplate component of FIG. 10A.
Figure 11:
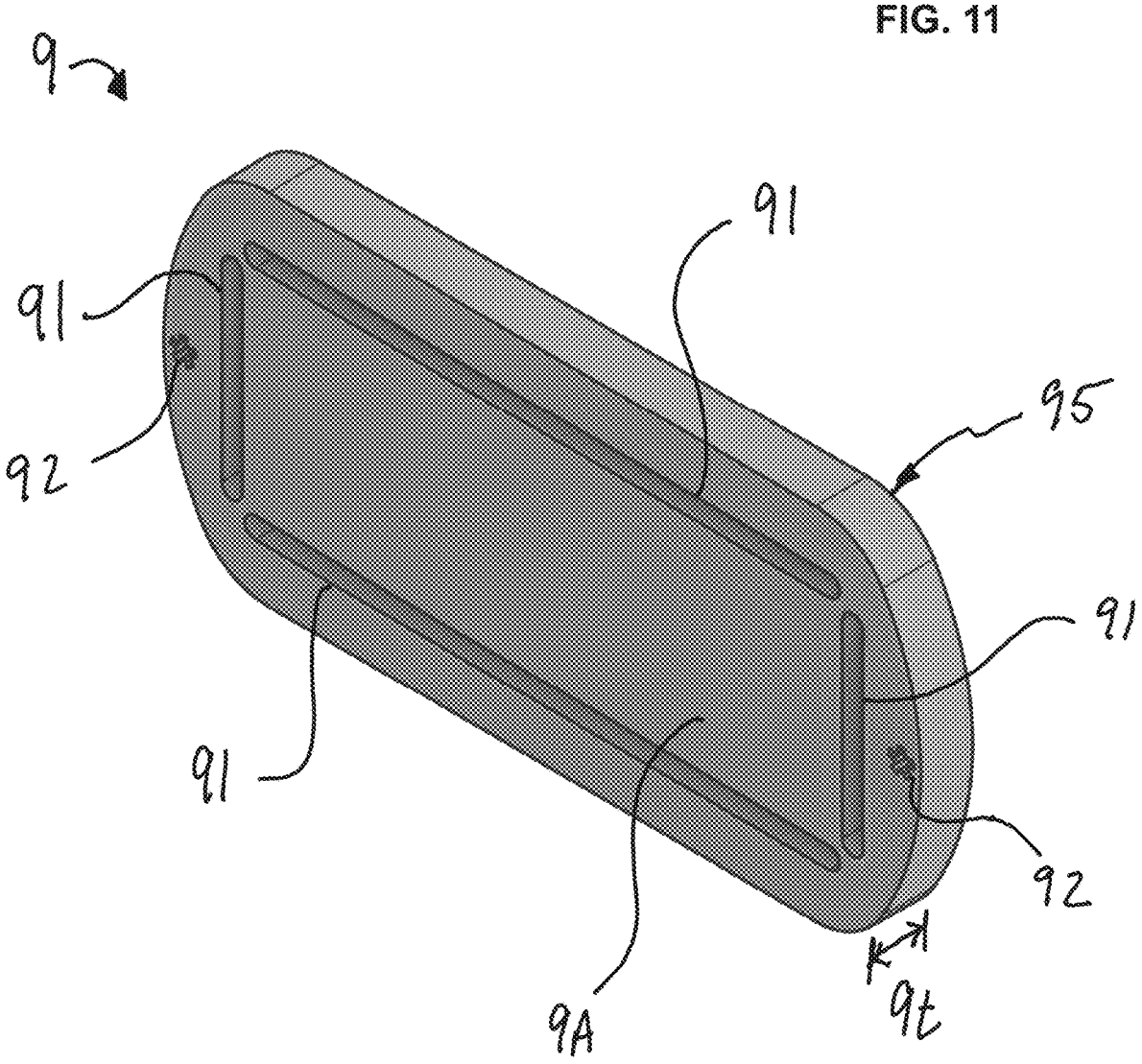
FIG. 11 shows a perspective view of a towel platform consistent with one embodiment of the present disclosure.

In some embodiments, as shown in FIGS. 4A-4H the housing back 1B, housing back sides 2 and 3, and paper support tray 9 are perforated with triangular holes 12A and 12B arranged in a grid pattern. The triangular perforations 12A and 12B maintain the structural integrity of the towel dispenser by distributing loads triangularly as done in many applications such as trusses and other support structures. The triangular perforations 12A and 12B can also reduce the weight of the housing back 1B, housing back sides 2 and 3, and paper support tray 9 by reducing the material necessary for the towel dispenser. The triangular holes 12A and 12B further allow for aeration of the towel dispenser and prevent fungus, bacteria, or virus growth and keep the towel dispenser clean. In some embodiments, as shown in FIG. 4G, the housing bottom 4 is perforated with holes resembling a floral pattern 13. The perforations resembling a floral pattern can also reduce the weight of the housing bottom 4 by reducing the material necessary for the towel dispenser. The perforations resembling a floral pattern 13 further allow for aeration of the towel dispenser and prevent fungus, bacteria, or virus growth and keep the towel dispenser clean (e.g., by enabling greater airflow compared to devices lacking such perforations). In some embodiments the perforations 14 in the housing bottom 4 are in other various patterns and shapes (not shown). For example and without limitation, these holes can be in the shapes of any polygon or non-polygon shape such as circles, ovals, triangles, squares, rectangles, trapezoids, pentagons, hexagons, heptagons, octagons, nonagons, and decagons.

The opening in the top periphery 6 of the top cover 5 comprises wear-resistant plastic and/or metal material. This wear-resistant material will lengthen the service life of the towel dispenser and protect the opening in the top periphery 6 from wear.

In some embodiments, the housing bottom 4 incorporates weighted or reinforced material to prevent moving or slipping of the housing 1A when the user removes a towel. In some embodiments, the housing bottom 4 is affixed with suction cups to affix the housing 1A to the desired surface. In some embodiments, the housing bottom 4 is affixed with adhesive to affix the housing 1A to the desired surface. In some embodiments, the housing bottom 4 comprises holes or tabs for mounting to the desired surface.

Referring now to FIGS. 4A-4H, towel dispensers consistent with the present disclosure comprise an elevator system 7 inside the housing 1A configured to elevate a support tray 9 along the predetermined offset angle 14. The spring-loaded mechanism 8 propels the support tray 9 along the elevator system 7. The spring-loaded mechanism 8 is configured to propel the paper support tray 9 along the predetermined offset angle 14. In some embodiments, the spring-loaded mechanism 8 is positioned at the bottom of the rail system 7 providing compression on the support tray 9 from the bottom periphery. In some embodiments, the spring-loaded mechanism 8 is positioned at the top of the rail system 7 providing tension on the support tray 9 from the top periphery 6.

In some embodiments, the spring-loaded mechanism 8 incorporates hydraulic struts (not shown) instead of or in addition to spring to propel the support tray 9.

The support tray 9 includes a generally planar top surface and is slidably associated with the elevator system 7. The elevator system 7 comprises a rail system 7 along which the support tray 9 is propelled. The support tray 9 supports the towels and helps to situate the towels against the top periphery 6 to facilitate dispensing of the towels.

In some embodiments, the support tray 9 is configured to accommodate tri-fold and c-fold towels having approximate dimensions of 9 inches by 11 inches (e.g., Torx Xpress Standard Multi-Fold Towels Model No. S-20940). In some embodiments, the support tray is configured to accommodate tri-fold and c-fold towels having approximate dimensions of 9.5 inches by 9.1 inches (e.g., Torx Model No. MK520A). In some embodiments, the support tray is configured to accommodate tri-fold and c-fold towels having approximate dimensions of 10.125 inches by 13.15 inches (e.g., Scott Model No. S-6080, Kleenex Model No. S-6867). In some embodiments, the support tray is configured to accommodate tri-fold and c-fold towels having approximate dimensions of 10 inches by 13 inches (e.g., Uline Kraft Model No. S-23403, Uline Deluxe Model No. S-7128). In some embodiments, the support tray is configured to accommodate tri-fold and c-fold towels having approximate dimensions of 9 inches by 9.5 inches (e.g., Uline Kraft Model No. S-13735, Uline Deluxe Model No. S-7127). In some embodiments, the support tray is configured to accommodate tri-fold and c-fold towels having approximate dimensions of 9.2 inches by 9.4 inches (e.g., Scott Model No. 01804). In some embodiments, the support tray is configured to accommodate tri-fold and c-fold towels having approximate dimensions of 9 inches by 13 inches (e.g., Uline Jumbo Model No. S-22310). In some embodiments, the support tray is configured to accommodate tri-fold and c-fold towels having approximate dimensions of 9.2 inches by 9.4 inches (e.g., Scott Model No. S-6866, Kleenex Model No. S-6868). In some embodiments, the support tray is configured to accommodate tri-fold and c-fold towels having approximate dimensions of 9 inches by 13 inches (e.g., Uline BigFold Z Model No. S-22310). In some embodiments, the support tray is configured to accommodate tri-fold and c-fold towels having approximate dimensions of 10 inches by 11 inches (e.g., Uline BigFold Z Model No. S-22311). In some embodiments, the support tray 9 is configured to accommodate pre-moistened wipes (e.g., baby wipes). In some embodiments, the pre-moistened wipes may be inserted into the device 100 and adjacent to the support tray 9 while still within their moisture-retaining packaging. In other embodiments, the pre-moistened wipes are first removed from their moisture-retaining packaging before being inserted into the device 100 and adjacent to the support tray 9.

One or more rails 16A,16B guides the support tray 9 along the offset angle 14 to elevate towels towards the opening 6 of the top cover 5. In some embodiments, the one or more rails 16A/16B comprise a stop 15 to limit advancement of the support tray 9 along the rails(s) 16A,16B. The support tray 9 has a generally planar top surface and peripherally located holes in a face of the tray configured to mate with the rails 16A,16B. The support tray 9 may be removable in these embodiments by detaching the stops 15 from the top of each rail 16A,16B. This allows for maintenance and cleaning of the support tray 9.

The top cover 5 is secured to the housing back 1B and housing sides 2 and 3 by a locking member 11 that fastens the top cover 5 to the housing back 1B and housing sides 2 and 3.

In some embodiments, the top cover 5 comprises a hole for a screw fastener for the locking of the top cover 5 to the housing back 1B and housing sides 2 and 3. The locking member 11 is configured to be unlocked by the motion (e.g., removal) of a screw fastener which mates the top cover 5 to the housing back 1B and housing sides 2 and 3.

Figure 1B:
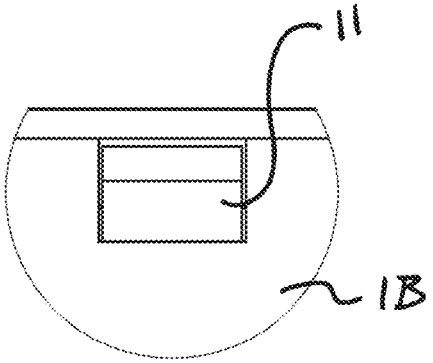
FIG. 1B shows an enlarged portion of a locking member consistent with the embodiments of the present disclosure.
Figure 1C:
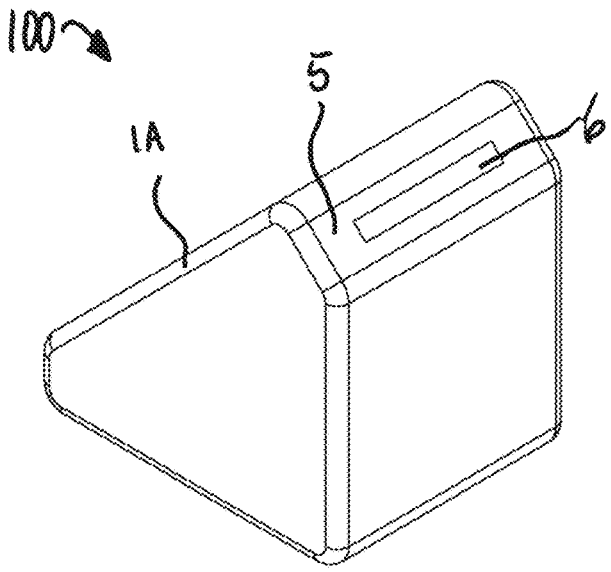
FIG. 1C shows a perspective view of the towel dispenser apparatus of FIG. 1A.
Figure 1D:
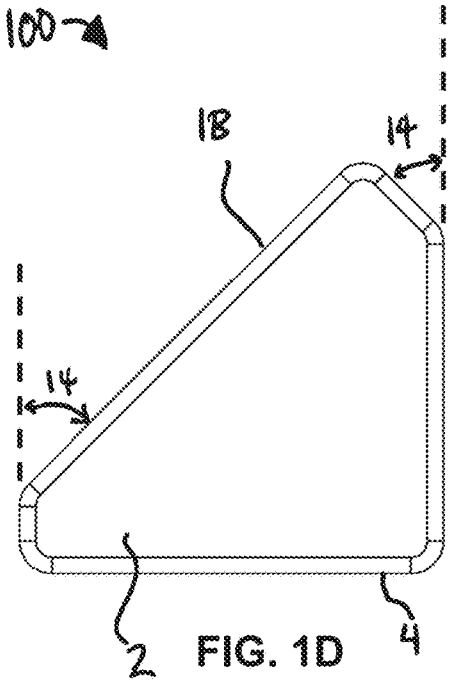
FIG. 1D shows a left side plan view of the towel dispenser apparatus of FIG. 1A.
Figure 1E:
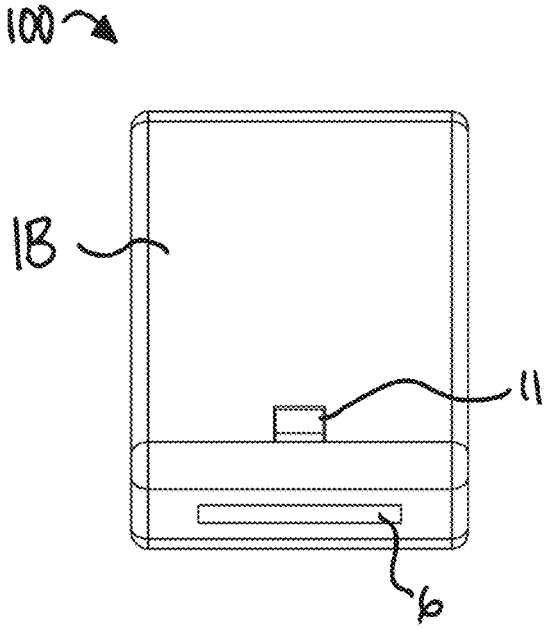
FIG. 1E shows a top plan view of the towel dispenser apparatus of FIG. 1A.
Figure 1F:
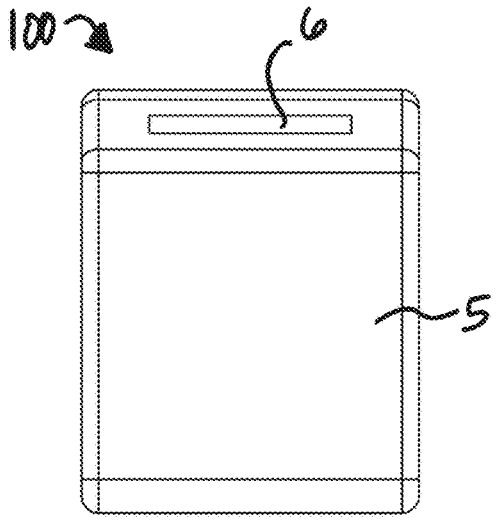
FIG. 1F shows a front plan view of the towel dispenser apparatus of FIG. 1A.
Figure 1G:
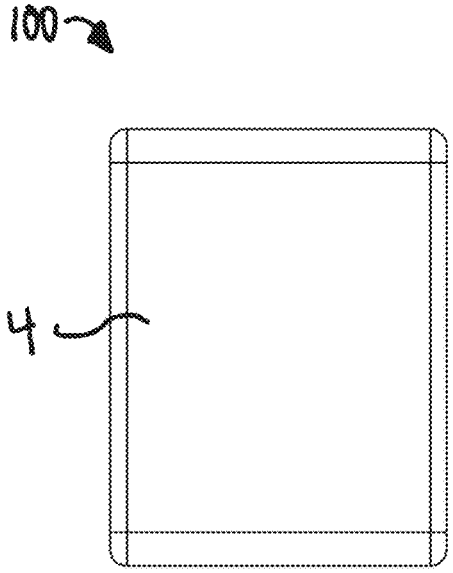
FIG. 1G shows a rear plan view of the towel dispenser apparatus of FIG. 1A.
Figure 1H:
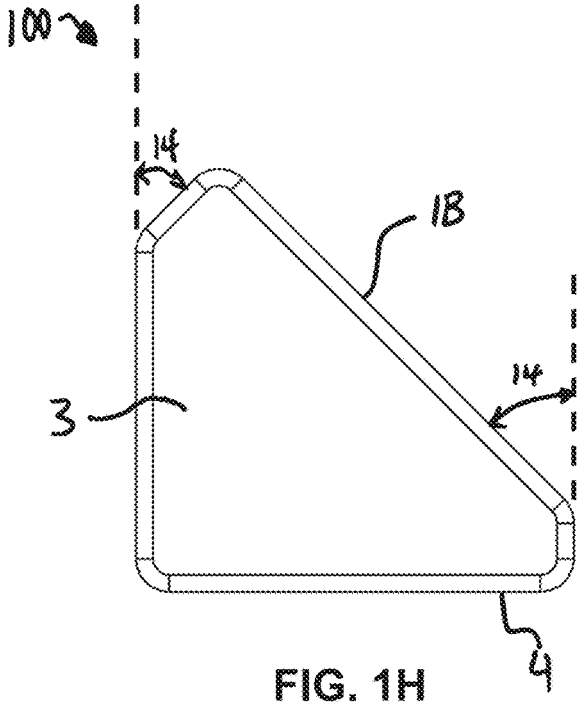
FIG. 1H shows a right side plan view of the towel dispenser apparatus of FIG. 1A.
Figure 2A:
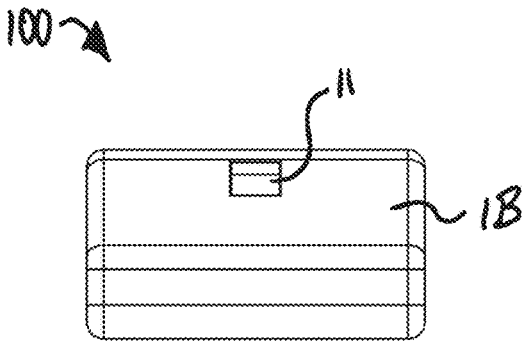
FIG. 2A shows a plan front view of a towel dispenser apparatus consistent with another embodiment of the present disclosure.
Figure 2B:
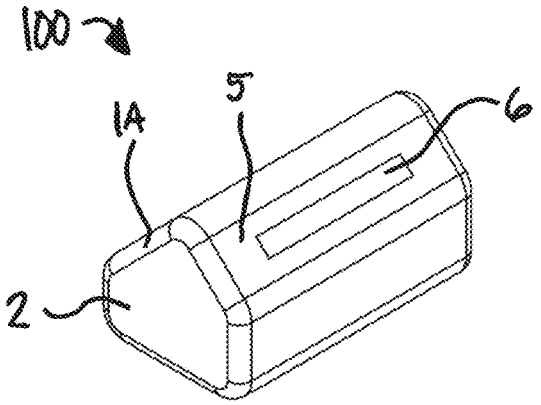
FIG. 2B shows a perspective view of the towel dispenser apparatus of FIG. 2A.
Figure 2C:
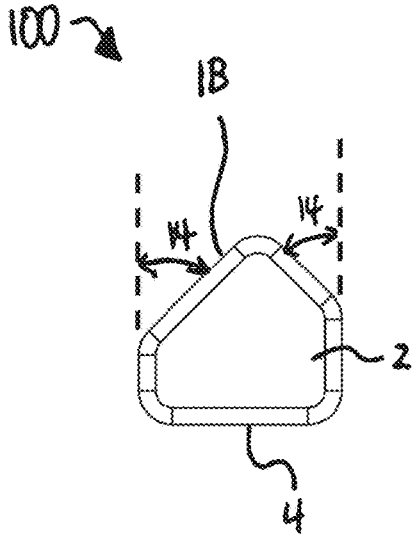
FIG. 2C shows a left side plan view of the towel dispenser apparatus of FIG. 2A.
Figure 2D:
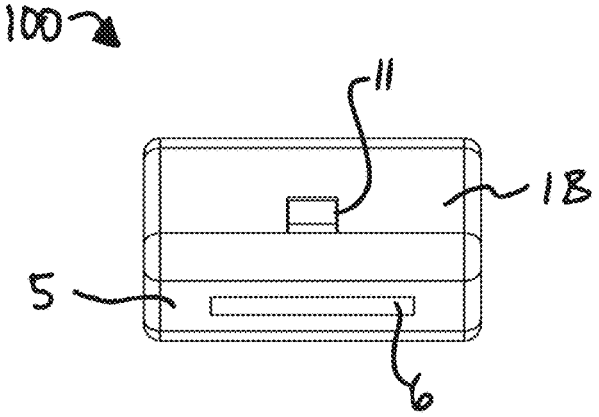
FIG. 2D shows a top plan view of the towel dispenser apparatus of FIG. 2A.
Figure 2E:
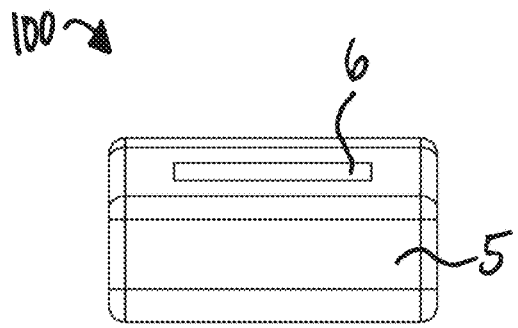
FIG. 2E shows a front plan view of the towel dispenser apparatus of FIG. 2A.
Figure 2F:
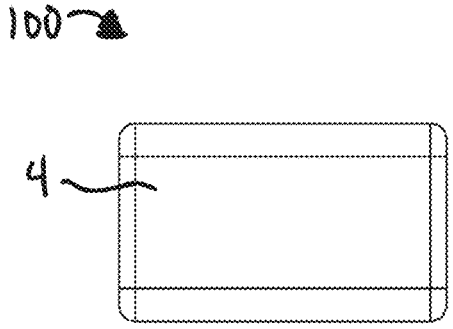
FIG. 2F shows a bottom plan view of the towel dispenser apparatus of FIG. 2A.
Figure 2G:
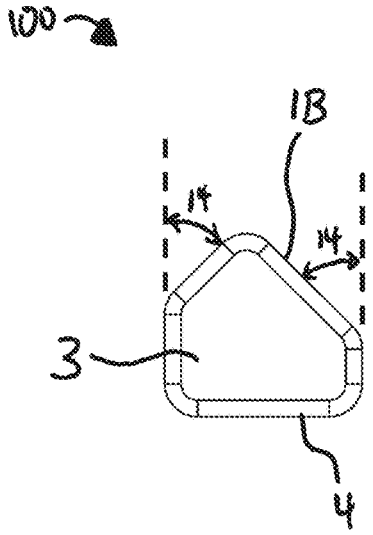
FIG. 2G shows a right side plan view of the towel dispenser apparatus of FIG. 2A.
Figure 3A:
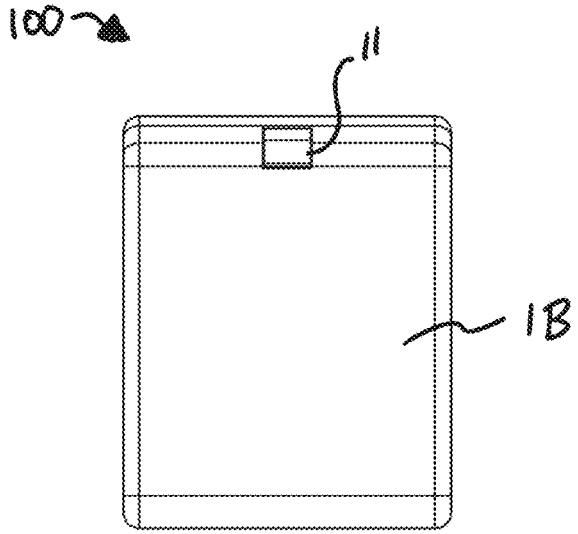
FIG. 3A shows a plan front view of a towel dispenser apparatus consistent with another embodiment of the present disclosure.
Figure 3B:
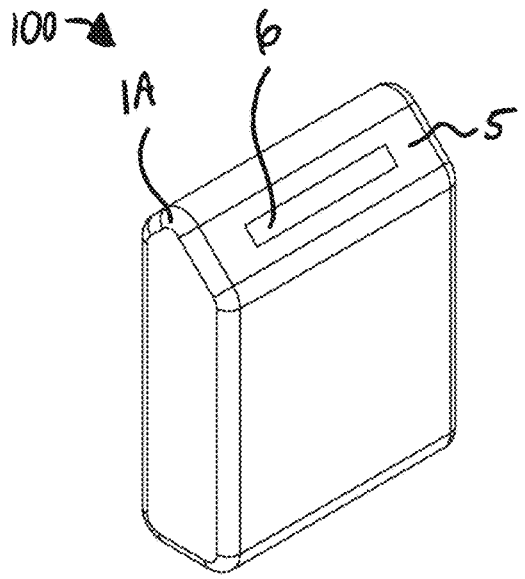
FIG. 3B shows a perspective view of the towel dispenser apparatus of FIG. 3A.
Figure 3C:
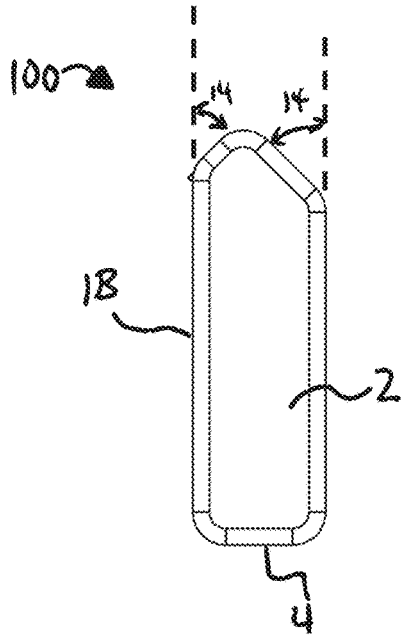
FIG. 3C shows a left side plan view of the towel dispenser apparatus of FIG. 3A.
Figure 3D:
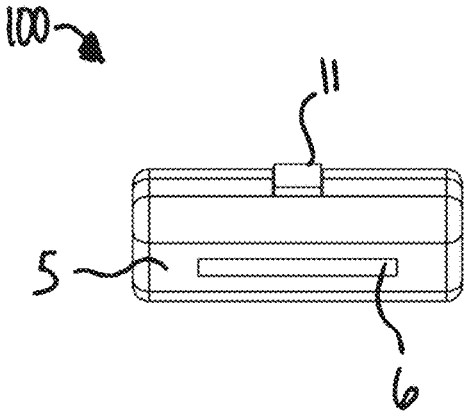
FIG. 3D shows a top plan view of the towel dispenser apparatus of FIG. 3A.
Figure 3E:
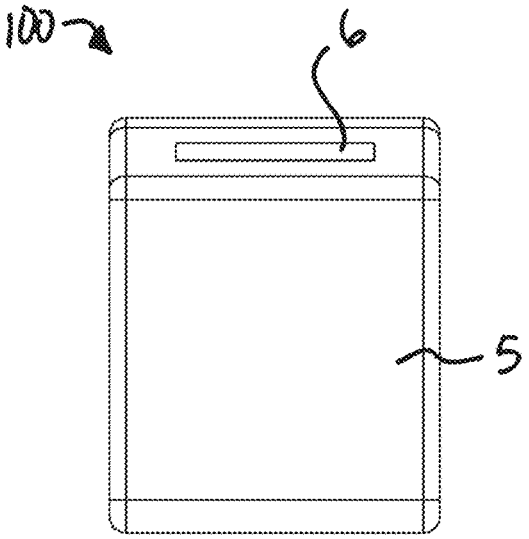
FIG. 3E shows a front plan view of the towel dispenser apparatus of FIG. 3A.
Figure 3F:
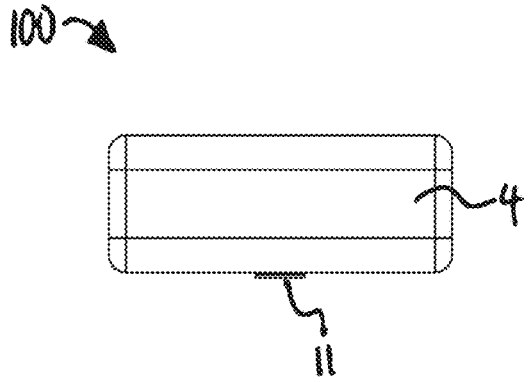
FIG. 3F shows a bottom plan view of the towel dispenser apparatus of FIG. 3A.
Figure 3G:
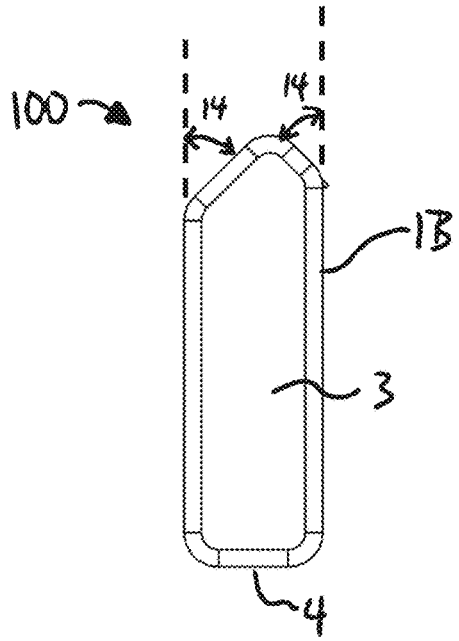
FIG. 3G shows a right side plan view of the towel dispenser apparatus of FIG. 3A.

The housing top cover 5 is configured such that the housing top cover 5 cannot be detached from the housing back 1B and housing sides 2 and 3 until the locking member 11 is disengaged. In some embodiments, the housing top cover 5 is removed by twisting the top cover 5 while one end remains affixed to the housing 1A. In some embodiments, the housing top cover 5 is detached from the housing 1A completely. In some embodiments, as shown in FIG. 1B, the locking member 11 comprises a latch mechanism, and is unlockable by depressing the latch mechanism to release the top cover 5 from the housing back 1B and housing sides 2 and 3, and wherein the top cover 5 cannot be removed from the housing without first unlocking the locking member 11. In some embodiments the housing top cover 5 opens but does not fully detach from the housing 1A.

In some embodiments, the housing back 1B is detached upon release of the locking member 11 and the housing top cover 5 remains attached to the housing 1A.

In some embodiments, the locking member 11 comprises a mechanical fastener and a spring-loaded button configured to enable one-touch activation and disengagement of the top cover 5. In some embodiments, the locking member 11 is located on the housing top cover 5. In some embodiments the locking member 11 is located on the housing side 2 as shown in FIGS. 5A-5J. In some embodiments the locking member 11 is located on the housing side 3 as shown in FIGS. 5A-5H. In some embodiments the locking member 11 is located on both housing sides 2 and 3 as shown in FIGS. 5A-5H.

Removal or release of the locking member 11 allows for loading of towels into the towel dispenser 100. Upon removal of the top cover 5, towels are placed onto the top side of the support tray 9. When fully loaded, the towels will depress the support tray 9 to its bottom position. The detachable top cover 5 can then be reattached by engaging the locking member 11. There is no requirement that the towel dispenser be fully loaded with towels and the towel dispenser 100 may be loaded with any amount less than maximum capacity.

Referring now generally to FIGS. 7-11, a towel dispenser apparatus 100 consistent with some embodiments of the present disclosure features a variable offset angle 14. In such embodiments, the offset angle 14 may be varied by, for example, adjusting a base 20 relative to the housing 1A. In the specific embodiment shown in FIGS. 7-11, for example, the offset angle 14 may be varied by rotating R the base bracket 21 thereby moving M the base 20 relative to the housing 1A. In some embodiments, the base bracket 21 is in operable communication with the housing 1A (e.g., with a side wall 2) via one or more base bracket receivers 22.

In some embodiments, the towel dispenser apparatus 100 includes one or more feet 4A configured to reduce or eliminate sliding of the towel dispenser apparatus 100 across a surface when the user pulls a towel from the opening 6 in the top 5.

In some embodiments, a top receiver 5B is disposed between the top 5 and the housing 1A. In such embodiments, the top receiver 5B may act as a stop to prevent the platform 9 from advancing beyond the one or more rails 16A, 16B.

In some embodiments, the top 5 includes a latch 11 configured to releasably mate with a latch receiver of the housing 1A to enable a user to selectively open and close the top 5. The latch 11 may include, for example, a bite 11A configured to enter the latch receiver (not shown), and a barb 11B configured to engage a ridge of the latch receiver. Depression of one side of the bite 11A may cause the barb 11B to disengage from the latch receiver, enabling the top 5 to be withdrawn from the housing 1A. When the top 5 is open, additional towels T may be inserted into the towel dispenser apparatus 100. When the top 5 is closed, towels T may be withdrawn one at a time through the opening 6.

In some embodiments, the housing 1A may include a top portion 2 and a bottom portion 2A configured to mate (e.g., temporarily mate) with each other to form the housing 1A.

In some embodiments, a back sleeve 1C is disposed over at least a portion of the housing back 1B. The back sleeve 1C may provide an aesthetically pleasing feature to the design of the housing 1A. In some embodiments, the back sleeve 1C reduces or prevents water and/or dust from entering the housing 1A, for example through an intersection of the housing back 1B and the housing side wall 2 and/or the bottom portion 2A.

In some embodiments, a top sleeve 1D is disposed over at least a portion of the top receiver 5A. The top sleeve 1D may provide an aesthetically pleasing feature to the design of the housing 1A. In some embodiments, the top sleeve 1D reduces or prevents water and/or dust from entering the housing 1A, for example through an intersection of the top 5 and the housing side wall 2 and/or the portion 2.

Towels T stored in the housing 1A may be advanced toward the opening 6 by the platform 9. An example embodiment of the platform 9 is shown representatively in FIG. 11. The platform 9 includes an outer shape 95 consistent with the cavity 2C defined by the housing 1A such that the platform 9 may readily slide toward the opening 6 in response to spring force applied on the platform 9 by the springs 8, and away from the opening 6 in response to force applied against the platform 9 by a user (e.g., while adding towels T to the dispenser 100). The platform 9 has a thickness 9*t* sufficient to resist deformation of the platform's shape in response to force applied on the platform 9 by the springs 8 and in response to force applied on the platform 9 by a user (e.g., while adding towels T to the dispenser 100).

In some embodiments, the platform 9 includes one or more vents 91 disposed from the platform's top surface 9A and the platform's back, opposite surface (not shown). In such embodiments, the vents 91 reduce or eliminate resistance caused by pressure differential in the cavity 2C across the platform 9, thus reducing the force that the springs 8 must exert on the platform 9 to readily advance toward the opening 6 in and the force that a user must exert on the platform 9 to readily retract the platform 9 away from the opening 6.

In some embodiments, the cavity 2C and the platform 9 are configured to accommodate tri-fold and/or C-fold towels as described in greater detail above. In some embodiments, the cavity 2C and the platform 9 are configured to accommodate pre-moistened (e.g., baby wipes) substantially surrounded by a moisture-retaining packaging. In other embodiments, the cavity 2C and the platform 9 are configured to accommodate pre-moistened wipes without their moisture-retaining packaging; in such embodiments, the housing 2 may be configured to resist rapid evaporation of fluid (e.g., cleaning fluid) embedded in the pre-moistened wipes during storage within the cavity 2C.

The platform 9 is associated with the rails 16A,16B. In some embodiments, the platform includes one or more channels 92 through which the rails 16A, 16B pass. In some embodiments, the channels 92 have a cross-sectional shape including a small, finite number of contact points (e.g., ridges) against which the rails 16A, 16B glide. Without wishing to be bound by theory, it is believed that the relatively small surface area of contact between the platform 9 and the rails 16A, 16B enable the platform 9 to readily advance toward the opening 6 in response to force from the springs 8 and to readily retract away from the opening 6 in response to force applied on the platform 9 by a user without the need for a lubricant to be disposed between the rails 16A, 16B and the platform 9.

In other embodiments, the platform 9 is associated with one or more telescoping pistons and one or more springs 8 such that the platform 8 is configured to advance toward the opening 6 in response to force from the springs 8 and to readily retract away from the opening 6 in response to force applied on the platform 9 by a user without a guide rail 16A, 16B passing through a channel 92 of the platform 9.

In the foregoing detailed description, numerous details, examples, and embodiments of the invention are described. However, it will be clear and apparent to one skilled in the art that the technology disclosed herein is not limited to the embodiments set forth and that the technology disclosed herein can be adapted for any of several applications. The drawings and specification describe various embodiments of the invention. Although specific terms are employed, the terms are used in a descriptive sense only and not for purposes of limitation. The invention has been described in detail with specific reference to the illustrated embodiments. It will be apparent, however, that various modifications and changes can be made within the spirit and scope of the invention as described in the specification and as defined in the appended claims.

What is claimed is:

1. A top-pull dispenser for towels comprising:

a housing having a housing back, housing sides, a housing bottom, and a detachable top cover connected thereto;

a said detachable top cover and said housing being disposed offset from vertical by a predetermined offset angle;

an opening in the top periphery of said top cover configured to dispense individual towels therethrough;

an elevator system configured to elevate a support tray along the offset angle and comprising a rail system along which the support tray is propelled, the rail system including a stop at a top end of each rail;

a spring-loaded mechanism to propel said support tray along said elevator system, wherein the support tray:

includes a generally planar top surface and is slidably associated with the elevator system along the offset angle, and is removable by detaching the stop of each rail; and a locking member for fastening said top cover to the housing back and housing sides.

2. The dispenser of claim 1, wherein the top cover comprises a hole for a screw fastener for the locking of the top cover to the housing back and housing sides.

3. The dispenser of claim 1, wherein the top cover is configured such that the top cover cannot be detached from the housing back and housing sides until the locking member is removed.

4. The dispenser of claim 1, wherein the top cover is disposed at an angle of at least about 40 degrees to about 50 degrees relative to vertical.

5. The dispenser of claim 1, wherein the housing back is disposed at an angle of at least about 40 degrees to about 50 degrees relative to vertical.

6. The dispenser of claim 1, wherein the housing top cover is disposed at an angle of at least about 40 degrees to about 50 degrees relative to vertical and the housing back height is about equal to the height of the housing sides.

7. The dispenser of claim 1, wherein the locking member is configured to be unlocked by the motion of a screw fastener which mates the top cover to the housing back and housing sides.

8. The dispenser of claim 1, wherein the opening in the top periphery of the top cover comprises wear-resistant plastic or metal material.

9. The dispenser of claim 1, wherein the housing back and housing sides comprises holes in the periphery configured to enable attachment by removable mechanical fasteners.

10. The dispenser of claim 1, wherein the housing back and housing sides are removable from the housing bottom by removable mechanical fasteners.

11. The dispenser of claim 1, wherein the housing back is perforated with triangular holes arranged in a grid pattern.

12. The dispenser of claim 1, wherein the housing bottom is perforated with holes resembling a floral pattern.

13. The dispenser of claim 1, wherein the rail system guides said support tray along the offset angle for dispensing towels through the top periphery of said top cover.

14. The dispenser of claim 1, wherein the support tray has a generally planar top surface and peripherally located holes in a face of the tray configured to mate with the rail system.

15. A towel dispenser comprising:

a housing including:

a top portion including:

a top receiver, a top plate associated with the top receiver and including:

an opening configured to permit a towel to pass therethrough, a latch configured to releasably mate with a latch receiver of the housing, and at least one top portion side wall adjacent the top receiver, and a bottom portion including:

a back plate, and at least one side wall associated with the back plate;

a platform disposed within the housing and configured to advance towels associated therewith toward the opening; and an adjustable base adjustably associated with the housing, wherein adjusting an orientation of the adjustable base relative to the housing causes an offset angle of the towel dispenser to change.

* * * * *